US006326733B1

(12) United States Patent
Schweickardt, Jr.

(10) Patent No.: US 6,326,733 B1
(45) Date of Patent: Dec. 4, 2001

(54) ELECTRONIC CIRCUIT TO INITIATE AND SUSTAIN CURRENT CONDUCTION IN GASEOUS DISCHARGE LAMPS AND METHOD

(75) Inventor: Karl Schweickardt, Jr., San Antonio, TX (US)

(73) Assignee: Starter Systems, Inc., Caliente, CA (US)

( * ) Notice: Subject to any disclaimer, the term of this patent is extended or adjusted under 35 U.S.C. 154(b) by 0 days.

(21) Appl. No.: 09/775,122

(22) Filed: Feb. 1, 2001

(51) Int. Cl.[7] ..... H05B 37/00
(52) U.S. Cl. ..... 315/119; 315/123; 315/128
(58) Field of Search ..... 315/200 R, 205, 315/DIG. 5, DIG. 7, 119, 128

(56) References Cited

U.S. PATENT DOCUMENTS 4,376,912 * 3/1983 Jernakoff ..... 315/248

* cited by examiner

*Primary Examiner*—David Vu
(74) *Attorney, Agent, or Firm*—Gunn, Lee & Keeling; Michelle Evans

(57) ABSTRACT

An electronic circuit is shown to initiate and sustain conduction in a gaseous discharge light. A breakover device and snubber network, isolation network, and self-adjusting symmetrical high voltage pulse generator are incorporated into a standard gaseous discharge light assembly typically composed of a power source, gaseous discharge lamp ballast apparatus, and gaseous discharge lamp. The electronic circuit is used (1) for initiating and sustaining conduction of electrical current through gaseous discharge lamps, (2) to provide active suppression of transient voltages both within and external to the gaseous discharge lighting apparatus, and (3) to provide significant attenuation of the propagation of undesirable conducted and radiated radio frequency interference from the gaseous discharge lamp and the overall associated ballast apparatus.

28 Claims, 2 Drawing Sheets

ELECTRONIC CIRCUIT TO INITIATE AND SUSTAIN CURRENT CONDUCTION IN GASEOUS DISCHARGE LAMPS AND METHOD

BACKGROUND OF THE INVENTION

1. Field of the Invention

Applicant's invention relates to an electrical apparatus and more particularly to devices normally employed as part of a gaseous discharge lighting system. The invention provides an electronic circuitry for initiating of electrical current through gaseous discharge lamps, sustaining conduction of electrical current through gaseous discharge lamps when such conduction of electrical current would otherwise cease, providing active suppression of electrical transient voltages within the apparatus normally employed with gaseous discharge lamps for their operation, providing active suppression of electrical transient voltages from sources internal and external to the gaseous discharge lighting apparatus, providing significant attenuation to the propagation of undesirable conducted radio frequency interference emissions back into the power line mains supplying power for the operation of gaseous discharge lighting equipment, and providing significant attenuation to radiated radio frequency interference emissions from the gaseous discharge lighting equipment.

2. Background Information

The typical gaseous discharge lamp can experience startup delays due to various problems. It is known that gaseous discharge lamps themselves present particular problems with regard to 1) starting at low ambient temperatures, 2) peculiarities intrinsic to the various types and sizes or power ratings of gaseous discharge lamp construction, 3) extended hot re-strike times if extinguished even very briefly due to external causes, such as loss of supplying power, and internal causes, such as age, during normal operation, and 4) changing their characteristics to beyond that which the associated ballasting apparatus can sustain conduction of electrical current through the particular gaseous discharge lamp. For example, if low pressure sodium lamps go out, the lamp will typically not relight for 20 minutes. This can cause safety and/or security problems depending on the location of the lamp.

Another significant disadvantage to present gaseous discharge lighting systems is high EMI/RFI interference from the lamp itself. It is known that during the operation of gaseous discharge lamps, various nonlinear effects intrinsic to the operation of gaseous discharge lamps commonly and inadvertently couple significant and undesirable radio frequency interference back into the power line mains supplying the power necessary for the operation of the overall gaseous discharge lighting apparatus and equipment as well as radiate significant and undesirable radio frequency interference energy into the environment from the lamps themselves. The standard gaseous discharge lighting system cannot be used in many countries due to strict regulations on electromagnetic noise pollution. A third problem with the existing gaseous discharge lighting systems is that there is no means by which to accurately set the breakover voltage of overvoltage protection devices into the system.

The present invention alleviates the problem of delayed starts by incorporating a self adjusting symmetrical high voltage pulse generator. The self-adjusting symmetrical high voltage pulse generator generates a series of pulses to restart the lamp whenever the lamp goes out or low temperature conditions prevent starting. Presently, it is well-known that a significantly higher than normal operating voltage must be applied to the lamps in order to initiate conduction of an electrical current through the active volume of the lamps. However it is not known in the prior art to apply such high voltage in a series of pulses from a self-adjusting symmetrical high voltage pulse generator.

The symmetry of the generator is also important in the reduction of EMI/RFI interference. The present invention allows the modification of existing gaseous discharge lighting systems for use in other countries that regulate electromagnetic noise pollution. The third benefit of the present invention is the incorporation of a precision electronic crowbar to provide a momentary short to protect the high voltage circuits from transient overvoltages.

SUMMARY OF THE INVENTION

It is an object of the present invention to provide a novel electrical device and method that initiates conduction of electric current through gaseous discharge lamps.

Another object of the present invention is to provide a novel electrical device and method that sustains conduction of electric current through gaseous discharge lamps.

Still another object of the present invention is to provide a novel electrical device and method that sustains conduction of electric current through gaseous discharge lamps when such conduction would otherwise cease.

It is yet an object of the present invention to provide a novel electrical device and method that actively suppresses electrical transient voltages within apparatus normally employed in the operation of gaseous discharge lamps.

It is still an object of the present invention to provide a novel electrical device and method that actively suppresses electrical transient voltages from sources external to the gaseous discharge lighting apparatus.

Another object of the present invention is to provide novel electrical device and method that provides significant attenuation to the propagation of undesirable conducted radio frequency interference emissions back into the power line mains supplying power for the operation of gaseous discharge lighting equipment.

Still another object of the present invention is to provide a novel electrical device and method that provides significant attenuation to radiated radio frequency interference emissions from the gaseous discharge lighting equipment.

In satisfaction of these and related objectives, Applicant's present invention provides for a gaseous discharge lighting system and method that incorporates a breakover device and snubber network, isolation networks, and self-adjusting symmetrical high voltage pulse generator to a system composed of a gaseous discharge lamp ballast apparatus and gaseous discharge lamp. The incorporation of these various components into a known gaseous discharge lighting assembly allows for the instant restart of the gaseous discharge lamp if the lamp goes out. In addition, the present invention allows for the reduction of the EMI/RFI noise pollution from the lamp. And last, the embodiment of the present invention allows for transient voltage suppression through the system by the use of a precision crowbar.

DETAILED DESCRIPTION OF THE PREFERRED EMBODIMENT

Figure 1:
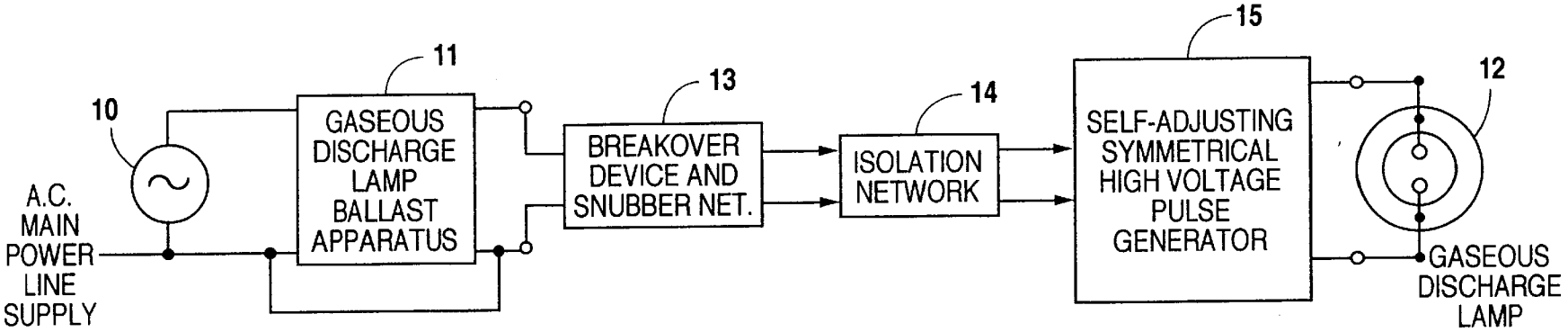
FIG. 1 is a block diagram of an electrical schematic for the present invention.

Referring to FIG. 1, a block diagram of the electrical schematic for the present invention is shown. Alternating current (AC) main power line supply 10 is connected to gaseous discharge lamp 12 by way of gaseous discharge lamp ballast apparatus 11, breakover device and snubber network 13, isolation network 14 and self adjusting symmetrical high voltage pulse generator 15. The AC main power line supply 10 is the utility electric source from which electric current is obtained. The present invention was designed to accommodate voltage from AC main power line supply 10 and can be from 95 volts to 550 volts and from approximately 45 cycles to approximately 66 cycles.

The AC main power line supply 10 feeds into the gaseous discharge lamp ballast apparatus 11. The gaseous discharge lamp ballast apparatus 11 operates as an inductor, the function of which is to limit and control the current of intrinsically unstable operation of the gaseous discharge lamp 12. Gaseous discharge lamps have a negative resistance characteristic (i.e. when current is increased through the lamp the voltage across the lamp decreases). Without some means of limiting and controlling the current, the current would otherwise increase without limit. Gaseous discharge lamp ballast apparatus 11 opposes any change in the current to limit and control the current. The gaseous discharge lamp ballast apparatus 11 used with the present invention can be of any type. In current practice, gaseous discharge lamp 12 is connected directly to gaseous discharge lamp ballast apparatus 11. However, in the present invention additional electrical components are added between gaseous discharge lamp 12 and gaseous discharge lamp ballast apparatus 11 to provide several benefits over the current practice.

In the preferred embodiment of the present invention, the gaseous discharge lamp ballast apparatus 11 is connected to a breakover device and snubber network 13. An AC voltage flows out of gaseous discharge lamp ballast apparatus 11 and into breakover device and snubber network 13. This AC voltage can be higher or lower than the power line voltage and may be in various wave forms. The breakover device portion of breakover device and snubber network 13 provides transient voltage protection and is activated by either the actual value of the voltage across it or the rate at which the voltage across it changes. This typically occurs under abnormal conditions. The typical breakover device is a triac and can be triggered by either its intrinsic properties or by external properties. The typical snubber would be a resistor and capacitor in series across the triac. The snubber network is designed to permit the triac to commutate to its off state when the line transients or load switching disturbances are no longer present.

From the breakover device and snubber network 13 is an isolation network 14. The function of the isolation network 14 is to disconnect or isolate the self-adjusting symmetrical high voltage pulse generator 15 and gaseous discharge lamp 12 from the gaseous discharge lamp ballast apparatus 11 which is essential to the operation of the EMI/RFI suppression characteristics of the present invention. Functionally the isolation network 14 acts as a very low impedance short circuit to high frequency currents or high frequency voltages. Isolation network 14 is connected to a self-adjusting symmetrical high voltage pulse generator 15, providing electrical power for its operation.

The function of the self-adjusting symmetrical high voltage pulse generator 15 is to generate high voltage starter pulses to initiate conduction through the gaseous discharge lamp 12. Gaseous discharge lamps typically require a high voltage to initiate conduction through the volume of the active material within the inner arc tube or glow tube of the gaseous discharge lamp 12; this high voltage can be a single or preferably a series of multiple pulses. The self-adjusting symmetrical high voltage pulse generator 15 operates, in the case of low pressure sodium lamps, when the lamp is extinguished due to a momentary power outage or when the lamp is very cold. The self-adjusting symmetrical high voltage pulse generator 15 is then connected to the gaseous discharge lamp 12. The gaseous discharge lamp 12 can be low pressure sodium, high pressure sodium, mercury vapor, metal halide, or other gaseous discharge lamps operating in either the low pressure glow or high pressure arc regimes.

Figure 2:
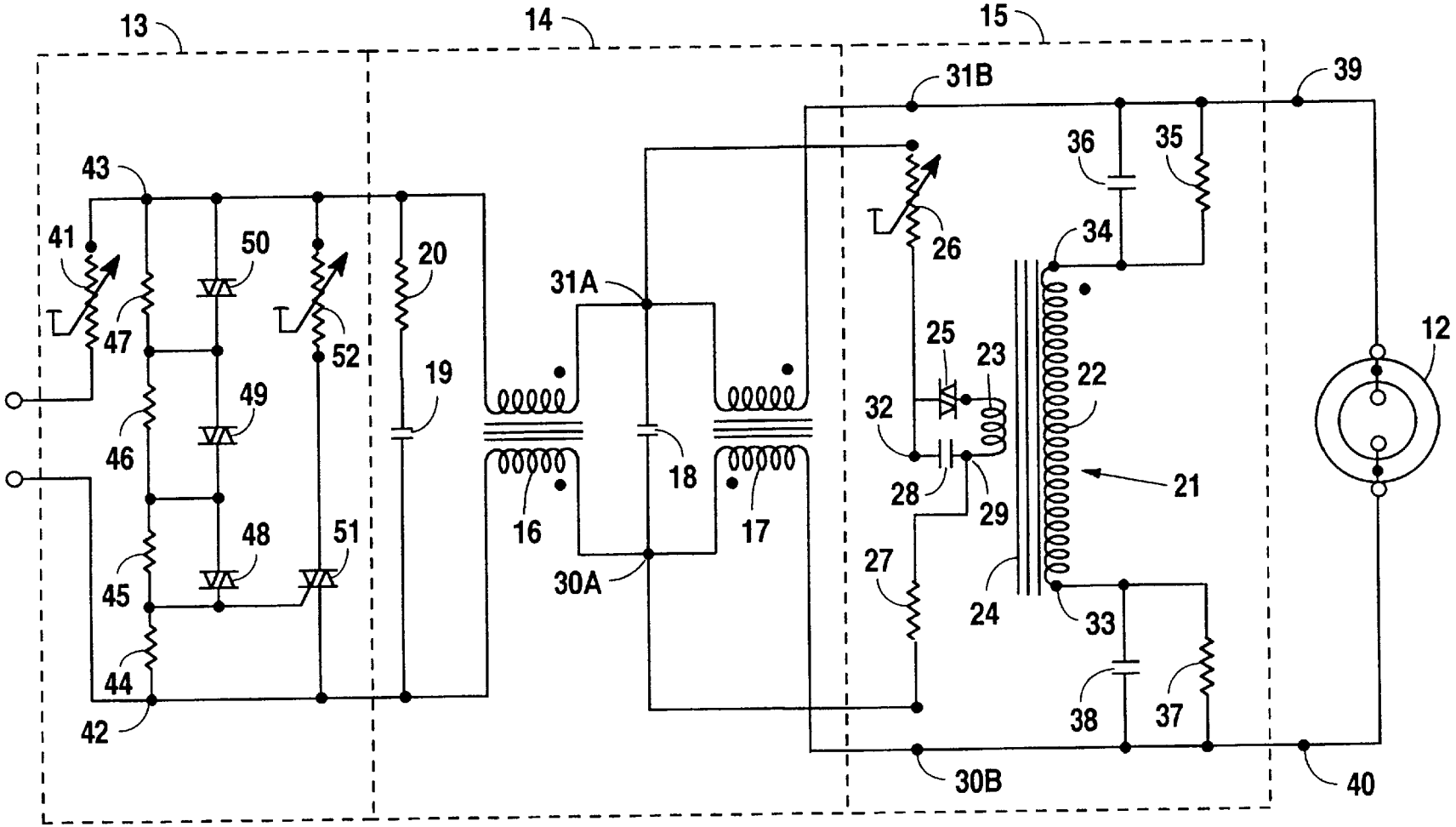
FIG. 2 is a detailed electrical schematic for the present invention.

FIG. 2 illustrates a detailed electrical schematic for the present invention. In the present invention alternating current is delivered from the AC main power line supply 10 (See FIG. 1). The current first flows through a gaseous discharge lamp ballast apparatus 11 (See FIG. 1) and into a breakover device and snubber network 13. The AC voltage can be higher or lower than the power line voltage and may be in various wave forms. The breakover device portion of breakover device and snubber network 13 provides transient voltage protection and is activated by either the actual value of the voltage across it or the rate at which the voltage across it changes. This typically occurs under abnormal conditions. The typical breakover device is a triac and it can be triggered by either its intrinsic properties or by extrinsic properties. The typical snubber network would be a resistor and capacitor in series across the triac. The snubber network is designed to allow the triac to commutate to its off state whenever the abnormal conditions are no longer present.

In the breakover device and snubber network 13 is a thermistor 41 which exhibits electrical resistance that varies with temperature and has a low value during normal operation, preferably being approximately 1 ohm. The function of thermistor 41 is as a self-resetting fuse. Thermistor 41 is preferably ceramic to alleviate any hysteresis effecting intrinsic to alternatives such as polymeric plastic thermistors. If a short occurs downstream from thermistor 41, it will get hot and the circuit will not function nor be damaged or present in hazard due to the several orders of magnitude increase in the resistance of thermistors. When the power is turned OFF or the short is removed, thermistor 41 will cool down and the circuit return to normal function.

Within breakover device and snubber network 13 and past thermistor 41 are terminals 42 and 43. Connected between terminals 42 and 43 is a series string of resistors 44, 45, 46, and 47. Resistor 44 is connected across gate main terminal 1 connections triac 51. This resistor 44 is of a low value, preferably in the range of 10 ohms. The function of resistor 44 is to bypass inadvertent unwanted currents from gate to main terminal 1 of triac 51. Resistors 45,46, and 47 are connected in series with respect to each other and in parallel respectively with SIDAC devices 48, 49, and 50. Resistors 45, 46, and 47 are high value resistors the function of which are to make the voltages that appear across SIDAC's 48, 49, and 50 balanced and exactly the same and within the non-breakover voltage of SIDAC's 48,49 and 50. The breakover voltage for the SIDACs is the minimum voltage required to cause the SIDAC to break down and conduct. The SIDAC's used in the preferred embodiment are preferably rated from 270 to 330 volts normal breakover voltage. Triac 51 is turned ON by the action of SIDAC's 48, 49, and 50 acting in conjunction with resistors 45, 46, and 47 if the low frequency power line voltage or a surge from a lamp flicking out exceed their breakover voltage. Once triac 51 is turned ON it short circuits the pulse and commutates OFF when the transient overvoltage level or rate of voltage rise across triac 51 are no longer present.

For fast rising transient pulses that may be due to a broken weld, loose socket, or bad connection, triac 51 will turn ON due to its intrinsic characteristics at gate main terminal 1 since applying sudden voltage to a triac will turn it ON. A capacitor exists between gate main terminal 1 and gate main terminal 2 of triac 51 that upon application of a sudden voltage to gate main terminal 2 will capacitively couple sufficient current into the gate to forward bias the gate-main terminal 1 junction and the triac 51 will turn ON. Typically this is not desired; however, it is beneficial to the present invention. The breakover voltage for triac 51 is preferably 800 volts, but typically triggered at 750 volts. Triac 51 is also connected in series with themistor 52.

Thermistor 52 has an electrical resistance that varies with temperature and, in conjunction with capacitor 19, acts as a snubber network to suppress the voltage change over time to ultimately allow the commutated turn OFF triac 51.

From breakover device and snubber network 13 is isolation network 14. The function of the isolation network 14 is to disconnect or isolate the self-adjusting symmetrical high voltage pulse generator 15 and gaseous discharge lamp 12 from the gaseous discharge lamp ballast apparatus 11 which is essential to the EMI/RFI suppression characteristics of the present invention. Functionally isolation network 14 acts as a short circuit at high frequencies.

To accomplish this within isolation network 14, capacitor 19 is connected in series with resistor 20. Capacitor 19 is a short circuit at high frequencies and an open circuit at low frequencies i.e. power line frequencies. Its value is preferably large on the order of approximately 0.1 microfarad. Resistor 20 is a very low value resistor which function is as a fuse. If capacitor 19 short circuits, resistor 20 blows up to prevent damage downstream. Downstream from capacitor 19 and resistor 20 are transformers 16 and 17. Transformers 16 and 17 are closed magnetic path transformers with ferrite cores of any closed magnetic path configuration such as toroid, E-core, El-core, L-core, C-core, or closed magnetic path wound with ordinary Class H magnet wire. The windings of transformers 16 and 17 are impregnated using standard vacuum techniques with a 100% solid system silicone based resin. This resin provides environmental resistance to moisture penetration, atmospheric pollution, decay, and pests.

Transformer 16 is phased, or connected, on the same side such that at high radio frequencies it functions as close as practicable to a short circuit. Transformer 17 is physically connected and built the same as transformer 16. However, transformer 17 is phased, or connected, on opposite sides such that at high radio frequencies it operates as an open circuit. The construction of both transformer 16 and transformer 17 is such that they have no effect in power line frequency. Both transformers 16 and 17 are more effective with progressively higher harmonic frequencies of the non-linear operations that are intrinsic to a gaseous discharge lamp. At low frequencies transformers 16 and 17 do nothing. Located between transformers 16 and 17 and across terminals 31A and 30A is capacitor 18. Capacitor 18 functions as a short circuit at high frequencies and as an open circuit at low frequencies. In addition, capacitor 18 assists in keeping the high frequencies from getting back into the gaseous discharge lamp ballast apparatus 11 and power line.

The connection of transformers 16 and 17 across terminals 31A and 30A results in a 42 dB decrease in the radiated EMI/RFI from gaseous discharge lamp 12 and a 40 dB decrease in the conducted EMI/RFI back into the gaseous discharge lamp ballast apparatus 11 and powerline.

Connected to the isolation network 14 is self adjusting symmetrical high voltage pulse generator 15. The function of the self adjusting high voltage pulse generator 15 is to generate a high voltage starter pulses to initiate conduction through the gaseous discharge lamp 12. Gaseous discharge lamp typically require a high voltage to initiate conduction through the volume of active material within the inner arc tube of the gaseous discharge lamp 12 which can be a pulse or multiple pulses. The self-adjusting symmetrical high voltage pulse generator 15 operates in the case of a low pressure sodium lamp when the lamp is extinguished due to a momentary power outage or when the lamp is cold to restart the lamp. It will also automatically generate sustaining "pilot-light" pulses to maintain conduction through the lamp 12 after the end of its normal operating lifetime.

Within self adjusting symmetrical high voltage pulse generator 15 and connected in series across terminals 30A and 31A are thermistor 26, capacitor 28, and fixed resistor 27. The fixed resistor 27 is a base fixed value and thermistor 26 is a ceramic positive temperature coefficient thermistor. Thermistor 26 is used to make a constant current flow between terminals 30A and 31A and automatically adjusts the circuit for the applied voltage over a range of approximately 90 to 550 RMS volts. The current flowing between terminals 30A and 31A is needed to charge capacitor 28. Capacitor 28 has constant impedance with respect to the combination thermistor 26 or fixed resistor 27 such that an essentially constant portion of power line frequency voltage appears across terminals 29 and 32 of capacitor 28 charging it up. When the power line frequency voltage across terminals 29 and 32 reaches the breakover voltage of SIDAC 25, SIDAC 25 turns from an open circuit to a short circuit. SIDAC 25 then dumps the charge from capacitor 28 into primary winding 23 of pulse transformer 21.

Pulse transformer 21 is a tall ratio transformer which lies across terminals 33 and 34. The number of turns on primary winding 23 is significantly less than the number of turns on secondary winding 22. The ratio is anywhere from 60:1 to 1500:1. The core 24 of pulse generator 21 is preferably a rod shaped slug of ferrites or powdered iron. The magnetic path of core 24 in pulse transformer 21 is open from end to end.

Self adjusting symmetrical high voltage pulse generator 15 is designed to generate a multitude of high voltage pulses, preferably 5 to 50, per alternate half cycle of the power line voltage. For example, for a 60 cycle/second power line, there could be as few as 10 or as many as 6000 pulses per second. This could be higher for some specialized applications with high pressure sodium and metal halide lamps.

Once the charge is dumped into primary winding 23 a very high voltage appears across terminals 33 and 34. In order to keep the power line voltage out of the secondary winding 22 to keep the secondary winding 22 from fusing together, a symmetrical set of resistors and capacitors are connected in series with terminals 33 and 34 going up to terminal 31B and down to terminal 30B. More particularly, resistor 35 is connected in parallel with capacitor 36. This parallel network is connected from terminal 34 to the wire that is connected to terminal 31B. Similarly, resistor 37 is connected in parallel with capacitor 38. This second parallel network is connected from terminal 33 to the wire that is connected to terminal 30B. The value for capacitors 36 and 38 is preferably on the order of 10 nanofarads (nF) and the value for resistors 35 and 37 is preferably on the order of 1 megaohms to 5 megaohms. Resistors 35 and 37 provide voltage stress equalization while the system is active and safely discharge capacitors 36 and 38 when power is not available.

The approximately 10 to 6,000 pulses per second are coupled into the bus connected to terminals 30B and 31B of block 15 by way of capacitors 36 and 38. At high frequencies the current is delivered to that bus. Gaseous discharge lamp 12 and transformer 17 are also connected across this bus. As mentioned, transformer 17 acts as an open circuit and therefore there is no current flowing through transformer 17. Therefore there is no where else for the current to go other than into gaseous discharge lamp 12. Gaseous discharge lamp 12 is connected across terminals 39 and 40 and can include low pressure sodium, high pressure sodium, mercury vapor, metal halide lamps, or other gaseous discharge lamps, operating in the low pressure glow or high pressure arc regimes. The current is used to get gaseous discharge lamp 12 turned ON in low temperature conditions or in situations where the lamp has gone out and it has not had time to cool off to restart itself as well as initiate conduction as normally required for certain types of gaseous discharge lamps as a requirement for their normal operation.

Self adjusting symmetrical high voltage pulse generator 15 is also designed to be symmetrical with isolation network 14 which, although not necessary for the operation of the gaseous discharge lamp 12, is necessary for the reduction of the EMI/RFI. The present embodiment reduces electromagnetic noise pollution coming from and through the gaseous discharge lamp 12 by a factor of 40 dB.

The present invention is also useful in brownout conditions. Assume low pressure sodium lamps are being used along a street, which lamps normally operate at 480 volts AC. Typically, these lamps have a 10% tolerance or will normally operate between approximately 440 volts AC and 520 volts AC. Typically, low pressure sodium lamps will operate a little further outside the tolerance on the high side than they will on the low side.

In the present invention, during brownout conditions, the lamp 12 is maintained ON because of the current flow through the positive temperature coefficient thermistor 26 and fixed resistor 27 maintains essentially a constant current through primary coil 23 of transformer 21. This constant current causes a relatively constant rate of pulses being generated by SIDAC 25, even during normal operating conditions. In other words, high voltage pulse generator 15 continues to generate pulses even during normal operation when the lamp 12 is continuously lit. While the energy level of the pulses will be relatively small when the lamp 12 is lit, the pulses are continually present and act as a pilot light to keep the lamp 12 lit. Therefore, when the line voltage drops in a brownout condition, the constant triggering pulses will cause the lamp 12 to stay lit to a much lower voltage level than would otherwise be the case. For example, assuming lamp 12 is a low pressure sodium lamp that would normally operate at approximately 480 volts AC, lamp 12 would operate in a brownout condition down to approximately 200 volts AC or somewhere within the 30 percentile range. Certainly, lamp 12 would be sustained in the ON position to well below 50% of normal operating voltage. During such brownout conditions, lamp 12 would give off less light, but would remain ON. Therefore, the pulses from the high voltage pulse generator 15 would sustain lamp 12 in the ON position during brownout conditions.

As lamps get older, the voltage requirements for the lamps increase over time. For example, if 100 volts were required to sustain the lamp 12 in the ON condition, as the lamp gets older, it might require up to 150 volts to maintain lamp 12 in the ON condition. Currently, as a lamp gets old, the lamp will ignite and burn for a period of time and then flick OFF. As the gas inside the tube cools down, the lamp will reignite and come back ON. This can be seen in streetlights that go OFF for a period of time and, after cooling, come back ON. The lamp is towards the end of its life cycle. In the present invention, due to the continuous firing of pulses caused by the current flow through thermistor 26 and fixed resistor 27, in combination with capacitor 28 and SIDAC 25 firing the primary winding 23 of the transformer 21, a continual series of pulses are being received across the lamp 12 from secondary winding 22. The series of pulses tend to sustain the lamp 12 in the ON condition, even though lamp 12 has deteriorated over time. The high voltage pulses being delivered to the lamp 12, as it nears the end of its life cycle, continue to keep the lamp 12 ON. Therefore, the high voltage pulses from the secondary winding 22 sustain lamp 12 in the ON condition as it nears the end of its normal life. This prevents flickering of the lamp 12 from the ON to the OFF condition and then back ON as the gases inside of the lamp 12 cool.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An electronic circuit to initiate and sustain current conduction in a gaseous discharge lamp, said electronic circuit for connection between said gaseous discharge lamp and a ballast receiving AC voltage thereto, said electronic circuit comprising:

a breakover device connected across said ballast to provide transient voltage protection;

a snubber connected across said ballast to minimize voltage spikes due to line transients or load switching;

a high voltage pulse generator connected across said gaseous discharge lamp; and an isolation network connected between said high voltage pulse generator and said ballast to isolate said high voltage pulse generator from said ballast by acting as a short circuit to high frequency currents or high frequency voltages.

2. The electronic circuit to initiate and sustain current conduction in said gaseous discharge lamp as given in claim 1, wherein said high voltage pulse generator is symmetrical.

3. The electronic circuit to initiate and sustain current conduction in said gaseous discharge lamp as given in claim 2, wherein said high voltage pulse generator is self adjusting.

4. The electronic circuit to initiate and sustain current conduction in said gaseous discharge lamp as given in claim 3, wherein said connection between said isolation network and said high voltage pulse generator is to said self adjusting symmetrical portion of said high voltage pulse generator.

5. The electronic circuit to initiate and sustain current conduction in said gaseous discharge lamp as given in claim 4, wherein said high voltage pulse generator generates a series of high voltage pulses per power line cycle until said gaseous discharge lamp is conducting.

6. The electronic circuit to initiate and sustain current conduction in said gaseous discharge lamp as given in claim 5 wherein said high voltage pulse generator continues to generate a series of high voltage pulses as required to sustain the conduction of current through said lamp when said lamp would otherwise extinguish.

7. The electronic circuit to initiate and sustain current conduction in said gaseous discharge lamp as given in claim 4, wherein said high voltage pulse generator is a transformer with a low turn primary winding and a high turn secondary winding, said primary winding being balanced and self adjusting, said primary winding connecting to said isolation network.

8. The electronic circuit to initiate and sustain current conduction in said gaseous discharge lamp as given in claim 1, wherein said breakover device includes a switching device that turns ON if voltage thereacross exceeds a predetermined point or a predetermined rate of rise.

9. The electronic circuit to initiate and sustain current conduction in a gaseous discharge lamp as given in claim 8, wherein said breakover device includes at least one self resetting fuse.

10. The electronic circuit to initiate and sustain current conduction in said gaseous discharge lamp as given in claim 9, wherein said self resetting fuse is a thermistor.

11. The electronic circuit to initiate and sustain current conduction in said gaseous discharge lamp as given in claim 10, wherein said thermistor is a positive temperature coefficient ceramic thermistor.

12. The electronic circuit to initiate and sustain current conduction in said gaseous discharge lamp as given in claim 1, wherein said isolation network includes thereacross a short circuit to high frequencies but an open circuit to power line frequencies.

13. The electronic circuit to initiate and sustain current conduction in said gaseous discharge lamp as given in claim 1, wherein said snubber permits commutation of said breakover device to its OFF state when transient voltages or load switching disturbances are no longer present.

14. The electronic circuit to initiate and sustain current conduction in said gaseous discharge lamp as given in claim 12, wherein said isolation network includes a pair of transformers with a first transformer acting as a short circuit to high frequencies and a second transformer acting as an open circuit to low frequencies, but said first transformer and said second transformer having no effect at low frequencies thereby decreasing radiated EMI/RFI from said gaseous discharge lamp.

15. A method for initiating and sustaining current conduction in a gaseous discharge lamp, said gaseous discharge lamp connecting to AC voltage through a ballast, said method comprising the steps of:

connecting a breakover device across said ballast to provide transient voltage protection;

snubbing across said ballast to minimize voltage spikes due to line transients or load switching;

generating high voltages pulses across said gaseous discharge lamp; and isolating said generating step from said ballast by acting as a short circuit to high frequency currents or high frequency voltages.

16. The method for initiating and sustaining current conduction in a gaseous discharge lamp of claim 15, wherein said generating step is symmetrical.

17. The method for initiating and sustaining current conduction in a gaseous discharge lamp of claim 16, wherein said generating step is self adjusting.

18. The method for initiating and sustaining current conduction in a gaseous discharge lamp of claim 17, wherein said generating step further comprises generating a series of high voltage pulses per power line cycle until said gaseous discharge lamp is conducting.

19. The method for initiating and sustaining current conduction in a gaseous discharge lamp of claim 18, wherein said generating step further comprises maintaining the conduction of current by generating more high voltage pulses whenever conditions would otherwise cause said lamp to extinguish.

20. The method for initiating and sustaining current conduction in a gaseous discharge lamp of claim 17, wherein said generating step includes a transformer with a low turn primary winding and a high turn secondary winding, said primary winding being balanced and self-adjusting with said primary winding being connected to said isolation network.

21. The method for initiating and sustaining current conduction in a gaseous discharge lamp of claim 15, wherein said breakover device includes a switching device that turns ON if voltage thereacross exceeds a predetermined point.

22. The method for initiating and sustaining current conduction in a gaseous discharge lamp of claim 21, wherein said breakover device includes at least one self resetting fuse.

23. The method for initiating and sustaining current conduction in a gaseous discharge lamp of claim 22, wherein said self resetting fuse is a thermistor.

24. The method for initiating and sustaining current conduction in a gaseous discharge lamp of claim 23, wherein said thermistor is a positive temperature coefficient ceramic thermistor.

25. The method for initiating and sustaining current conduction in a gaseous discharge lamp of claim 15, wherein said isolating step includes thereacross a short circuit to high frequencies but an open circuit to power line frequencies.

26. The method for initiating and sustaining current conduction in a gaseous discharge lamp of claim 15, wherein said snubbing step allows said breakover device to commutate to its OFF state when transient voltages or load switching disturbances are no longer present.

27. The method for initiating and sustaining current conduction in a gaseous discharge lamp of claim 25, wherein said isolating step includes a pair of transformers with a first transformer acting as a short circuit to high frequencies and a second transformer acting as an open circuit to low frequencies, but said first transformer and said second transformer having no effect at low frequencies thereby decreasing radiated EMI/RFI from said gaseous discharge lamp.

28. The method for initiating and sustaining current conduction in a gaseous discharge lamp of claim 27, wherein said first transformer and said second transformer decrease conducted EMI/RFI back into a power line supplying power to said lamp.

* * * * *